US007094974B2

(12) United States Patent
Ohkawa et al.

(10) Patent No.: US 7,094,974 B2
(45) Date of Patent: Aug. 22, 2006

(54) POLYMER SP INSULATOR

(75) Inventors: Yasushi Ohkawa, Nagoya (JP); Itsushi Nakamura, Aichi (JP)

(73) Assignee: NGK Insulators, Ltd., Aichi (JP)

( * ) Notice: Subject to any disclaimer, the term of this patent is extended or adjusted under 35 U.S.C. 154(b) by 0 days.

(21) Appl. No.: 11/285,104

(22) Filed: Nov. 23, 2005

(65) Prior Publication Data

US 2006/0131063 A1 Jun. 22, 2006

(30) Foreign Application Priority Data

Dec. 1, 2004 (JP) ..... 2004-348251

(51) Int. Cl.
*H01B 17/26* (2006.01)

(52) U.S. Cl. ..... 174/142; 174/140 S; 174/152 R; 174/158 R; 174/179; 174/209

(58) Field of Classification Search ..... 174/11 BH, 174/12 R, 12 BH, 13, 14 BH, 31 R, 137 R, 174/209, 138 R, 138 D, 140 R, 140 H, 140 S, 174/142–144, 150, 152 R, 154, 158 R, 161 R, 174/163 R, 164, 165, 166 R, 167, 169, 171, 174/174, 179, 193, 197
See application file for complete search history.

(56) References Cited

U.S. PATENT DOCUMENTS 4,190,736 A * 2/1980 Warnet et al. ..... 174/209
5,336,852 A * 8/1994 Goch et al. ..... 174/179
5,389,742 A * 2/1995 Clabburn et al. ..... 174/209
5,977,487 A * 11/1999 Kuhl ..... 174/177
5,986,216 A * 11/1999 Krause ..... 174/179
6,064,010 A * 5/2000 Bessede ..... 174/176
6,218,626 B1 * 4/2001 Giampieretti et al. ... 174/158 R
6,222,134 B1 * 4/2001 Aoyama et al. ..... 174/158 R
6,229,094 B1 * 5/2001 Krause ..... 174/177
6,501,029 B1 * 12/2002 Guillemette et al. ..... 174/209
6,624,360 B1 * 9/2003 Meinherz ..... 174/152 R
6,693,242 B1 * 2/2004 Bailey ..... 174/152 R

FOREIGN PATENT DOCUMENTS

JP 11-312421 11/1999

* cited by examiner

*Primary Examiner*—Dean A. Reichard
*Assistant Examiner*—Adolfo Nino
(74) *Attorney, Agent, or Firm*—Steptoe & Johnson LLP

(57) ABSTRACT

A polymer SP insulator comprising an FRP core 1, a sheath 2 having a plurality of sheds 6 provided on outer periphery of FRP core 1, and metal-end-fittings 3, 4 crimped to upper and lower ends of FRP core 1, in which a flat plate 11 for adjusting the overall length dimension after crimping the metal-end-fitting 4 is assembled in the inner bottom of the metal-end-fitting 4, and the overall length dimension is uniformly adjusted by the thickness of the flat plate 11. Further, a stress concentration portion such as cross groove is provided in the outer bottom of the lower Metal-end-fitting 4, and prevents instability by deformation of flange 8 when crimping the Metal-end-fitting 4. In this configuration, in spite of the structure of crimping metal-end-fittings at upper and lower ends of the FRP core, the overall length tolerance, parallelism and eccentricity can be suppressed. In order to assure the flashover distance economically, preferably, the diameter of sheds of at least highest position and lowest position is larger than the diameter of intermediate shed.

4 Claims, 8 Drawing Sheets

POLYMER SP INSULATOR

CLAIM OF PRIORITY

This application claims priority under 35 USC 119 to Japanese Patent Application No. 2004-348251, filed on Dec. 1, 2004, the entire contents of which is hereby incorporated by reference.

BACKGROUND OF THE INVENTION

1. Field of the Invention

The present invention relates to a polymer SP (station post) insulator used in support of electric power devices such as bus bar and disconnecting switch.

2. Description of the Related Art

For supporting electric power devices such as bus bar and disconnecting switch at a substation, hitherto, porcelain-made SP insulators have been mainly used, but recently polymer SP insulators are also used as disclosed in Japanese Patent Application Laid-Open No. 1999-312421. The polymer SP insulator is a support insulator formed by covering the outer periphery of FRP core with a rubber sheath having a shell and a plurality of sheds, and crimping metal-end-fittings to upper and lower ends of FRP core, and it is excellent in quake resistance, and there are its needs in quake-stricken regions and nations.

To be used as support insulator, the polymer SP insulator is demanded to have a high dimensional precision. For example, according to the ANSI standard of the United States where polymer SP insulators are highly demanded, for a polymer SP insulator of overall length of 30 inches (762 mm), the overall length tolerance is within +/−0.8 mm, the parallelism is within +/−0.8 mm, and the eccentricity is within +/−3.2 mm. FIG. 1 shows methods of measuring overall length h, parallelism p, and eccentricity e. The parallelism p is defined as the difference of highest point and lowest point of reference circle of bolt circle diameter at upper end of insulator, and the eccentricity e is defined as deviation of center point of upper and lower ends.

As mentioned above, the polymer SP insulator is formed by crimping metal-end-fittings to upper and lower ends of FRP core. At the time of crimping, deviation or elongation occurs in the metal-end-fittings. Or when cutting the FRP core, fluctuations occur in the cutting length. Due to these reasons, it is not easy to satisfy the strict requirements of overall length tolerance of SP insulator, such as overall length tolerance of ANSI standard.

The metal-end-fitting is an integrally cast part consisting of tubular parts crimped to the upper and lower ends of FRP core and a flange formed at the end, and when the tubular parts are crimped inside at two opposite positions, the crimping effect causes the elongation of the tubular part in axial direction, and the flange may be warped and deformed as shown by exaggeration in FIG. 2. Accordingly, as for the parallelism and eccentricity tolerance, too, it is not easy to settle within the strict tolerance of SP insulator such as ANSI standard.

It is hence an object of the invention to present a polymer SP insulator capable of suppressing the overall tolerance within the ANSI standard requirement etc. in a structure formed by crimping metal-end-fittings to upper and lower ends of FRP core, and also suppressing the parallelism and eccentricity by deformation of flange within the ANSI standard requirement etc.

SUMMARY OF THE INVENTION

To achieve the primary object, the polymer SP insulator of the invention comprises an FRP core, a sheath having a plurality of sheds provided on outer periphery of FRP core, and metal-end-fittings crimped to upper and lower ends of FRP core, in which a flat plate for adjusting the overall length dimension after crimping the metal-end-fittings is assembled in the inner bottom of both or one of upper and lower metal-end-fittings, a stress concentration portion is provided in the outer bottom of at least lower metal-end-fitting to deform the flange outer edge of the metal-end-fitting toward the tubular part without the entire bottom of the flange being deformed at the time of crimping the tubular part of the metal-end-fitting.

The polymer SP insulator of the invention can adjust the overall length dimension by the thickness of the flat plate, and the overall length tolerance can be easily controlled within the required range of ANSI standard etc. Besides, at least in the outer bottom of the lower metal-end-fitting, a stress concentration portion for deforming the flange outer edge of the metal-end-fitting by following up the tubular part side at the time of crimping the tubular part of the metal-end-fitting is provided, and the deforming position can be specified, and the entire flange is not curved. Hence, the parallelism and eccentricity can be also controlled within the required range of ANSI standard etc.

Besides, if a non-crimping portion of 15% or more of overall height of the metal-end-fitting is provided in a portion on the flange of tubular part of the metal-end-fitting, it is effective to suppress increase of parallelism or eccentricity due to deformation of flange. Moreover, in the insulator overall length specified by ANSI standard, in order to obtain flashover distance satisfying the insulation characteristic specified by the standard, at least the diameter of sheds in the highest part and lowest part can be set larger than the diameter of the shed in the intermediate part. Thus, the flashover distance is assured, and the volume of the shed materials is suppressed as compared with the case of increasing the entire shed diameter, and the flashover distance can be assured economically. By the corresponding portion, the vertical length of metal-end-fitting can be extended, and the mechanical strength of insulator can be enhanced.

DETAILED DESCRIPTION OF THE INVENTION

A preferred embodiment of the invention is specifically described below.

Figure 3:
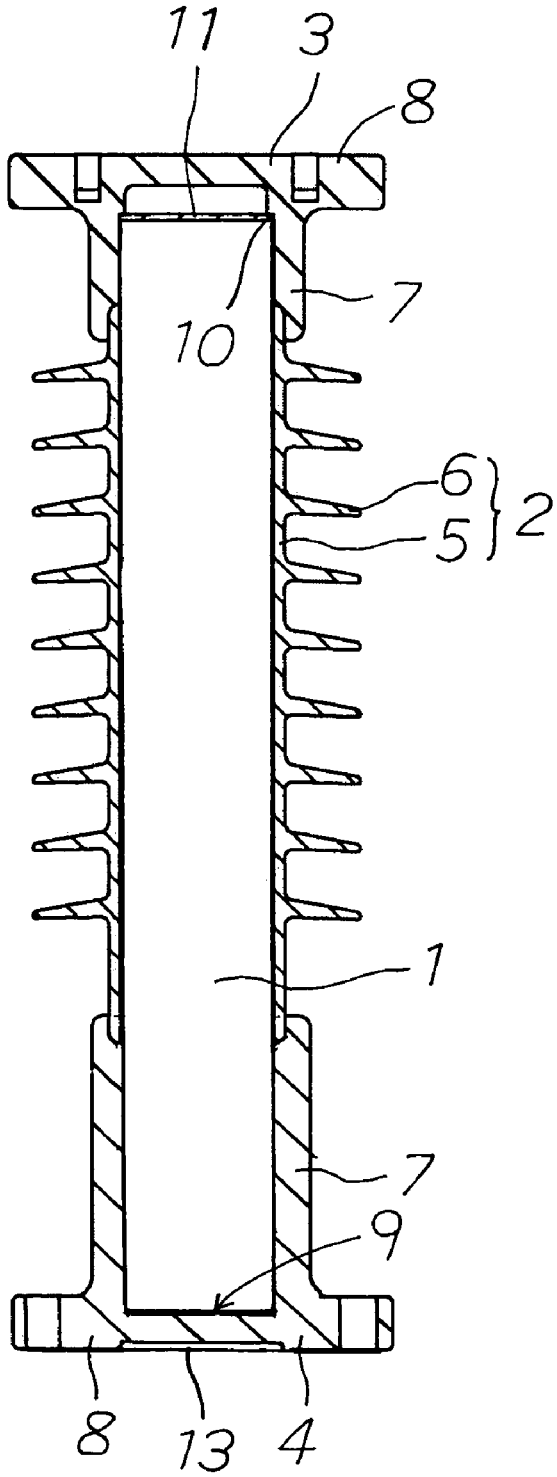
FIG. 3 is a sectional view of polymer SP insulator of the invention.

FIG. 3 is a sectional view of polymer SP insulator of the invention. This polymer SP insulator comprises a columnar FRP core 1, a rubber sheath 2 provided on the outer periphery of FRP core 1, and metal-end-fittings 3, 4 crimped to upper and lower ends of FRP core 1. The rubber sheath 2 integrally includes a shell 5 covering the entire outer periphery of FRP core 1, and a plurality of sheds 6 projecting outside from the shell 5.

As shown in FIG. 3, the lower metal-end-fitting 4 is a cast part having a tubular part 7, and a flange 8 projecting outside from its end, and the inside diameter of tubular part 7 is cut and processed to be slightly larger than the outside diameter of FRP core 1. The FRP core 1 inserted into the tubular part 7, and by crimping the tubular part 7, the metal-end-fitting 4 and FRP core 1 are fixed. 'Flange' means the whole part of the bottom of metal-end-fitting.

Similarly, the upper metal-end-fitting 3 is a cast part having a tubular part 7, and a flange 8 projecting outside from its end, and in the inner bottom of the tubular part 7, a step 10 to be engaged with the upper end of FRP core 1 is cut and processed. Between the upper end of FRP core 1 and this step 10, a flat plate 11 for adjusting the overall length dimension is inserted, and in this state, finally, the tubular part 7 is crimped and fixed to the FRP core 1. Its manufacturing process is as follows.

Figure 4:
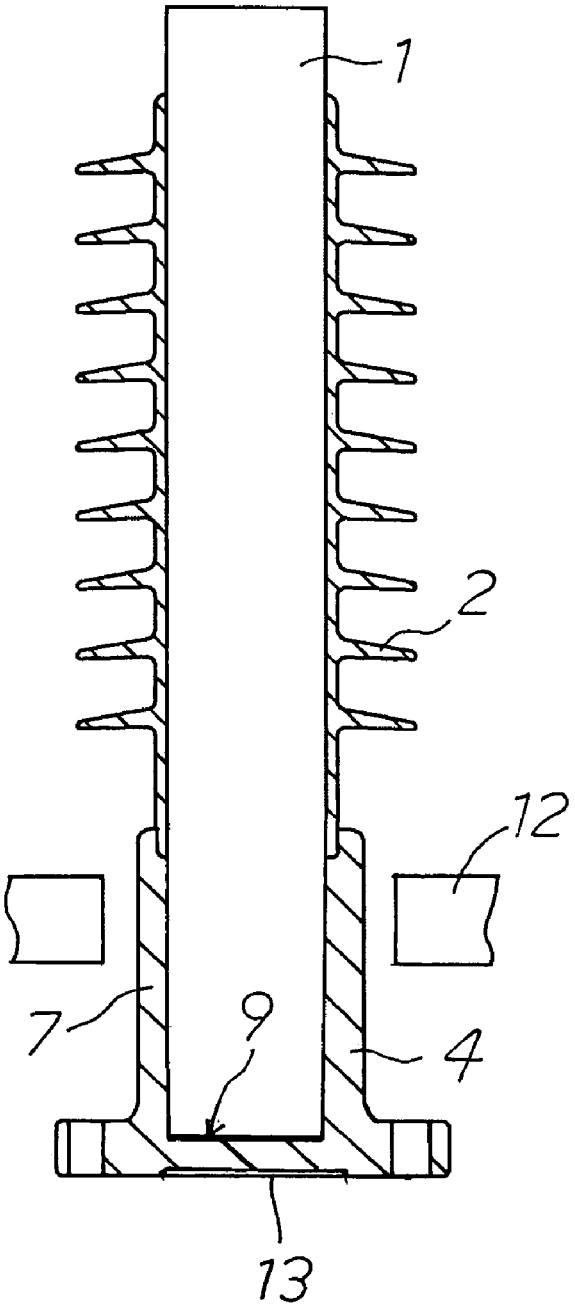
FIG. 4 is an explanatory diagram of manufacturing process of polymer SP insulator of the invention.

First, as shown in FIG. 4, the FRP core 1 preliminarily molding the rubber sheath 2 is inserted into the tubular part 7, and the tubular part 7 is crimped and fixed by a crimping tool 12. As mentioned above, fluctuations of cutting length occur inevitable in the FRP core 1, and deviation or elongation by plastic deformation is inevitable in the metal-end-fitting 4 by crimping. Accordingly, in the invention, in the state shown in FIG. 4, the overall length is measured from the lower side of the metal-end-fitting 4 to the upper end of the FRP core 1, and error from standard length is calculated.

Figure 5:
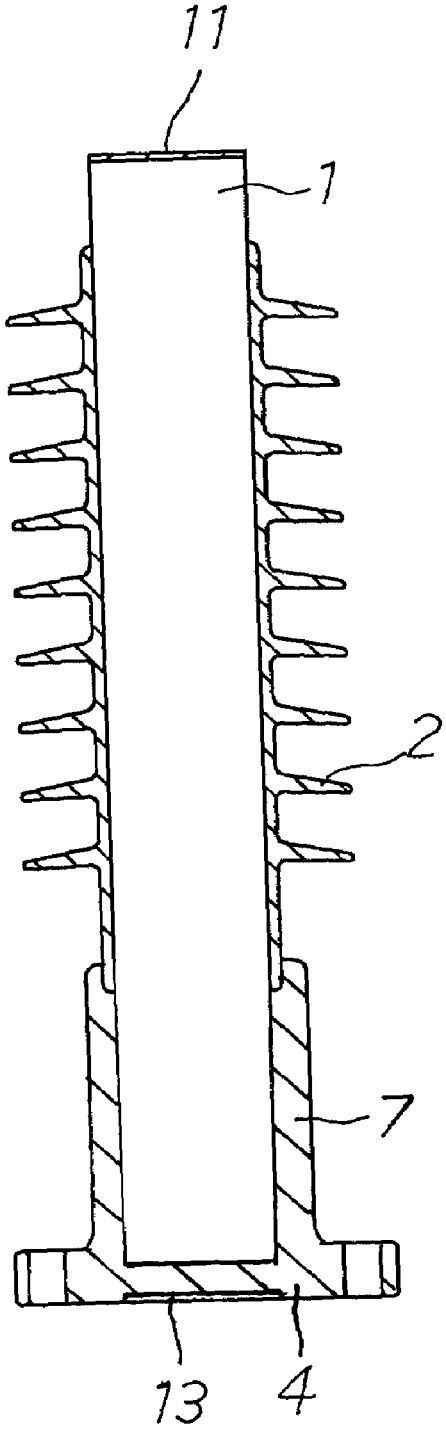
FIG. 5 is an explanatory diagram of manufacturing process of polymer SP insulator of the invention.

The flat plate 11 for adjusting the overall length dimension is, for example, steel plate or metal plate, and multiple types different in plate thickness at intervals of, for example, 0.2 mm are prepared, and a flat plate 11 of thickness corresponding to calculated error from standard length is put on the upper end of FRP core 1 as shown in FIG. 5. For example, if the overall length measured in the state in FIG. 4 is shorter than the standard length by 0.6 mm, a flat plate 11 of thickness of 0.6 mm is used. In the invention, in order to adjust the overall length by inserting the flat plate 11, the FRP core 1 should be cut slightly shorter so that the overall length measured in the state in FIG. 4 may not be longer than the standard length.

Afterwards, the upper metal-end-fitting 3 is put on to cover the upper end of FRP core 1, and crimped and fixed, so that the polymer SP insulator shown in FIG. 3 is obtained. As a result, the entire structure is assembled in the state of the flat plate 11 inserted between the step 10 formed in the inner bottom of tubular part 7 and the upper end of FRP core 1. When crimping and fixing the upper metal-end-fitting 3, an error due to plastic deformation occurs, but this error can be predicted, and therefore the overall length tolerance of polymer SP insulator can be suppressed within the range demanded by ANSI standard. In the embodiment described herein, the flat plate 11 is put in the inner bottom of the upper metal-end-fitting 3, but flat plates 11 may be inserted into both upper and lower metal-end-fittings 3, 4.

Figure 6:
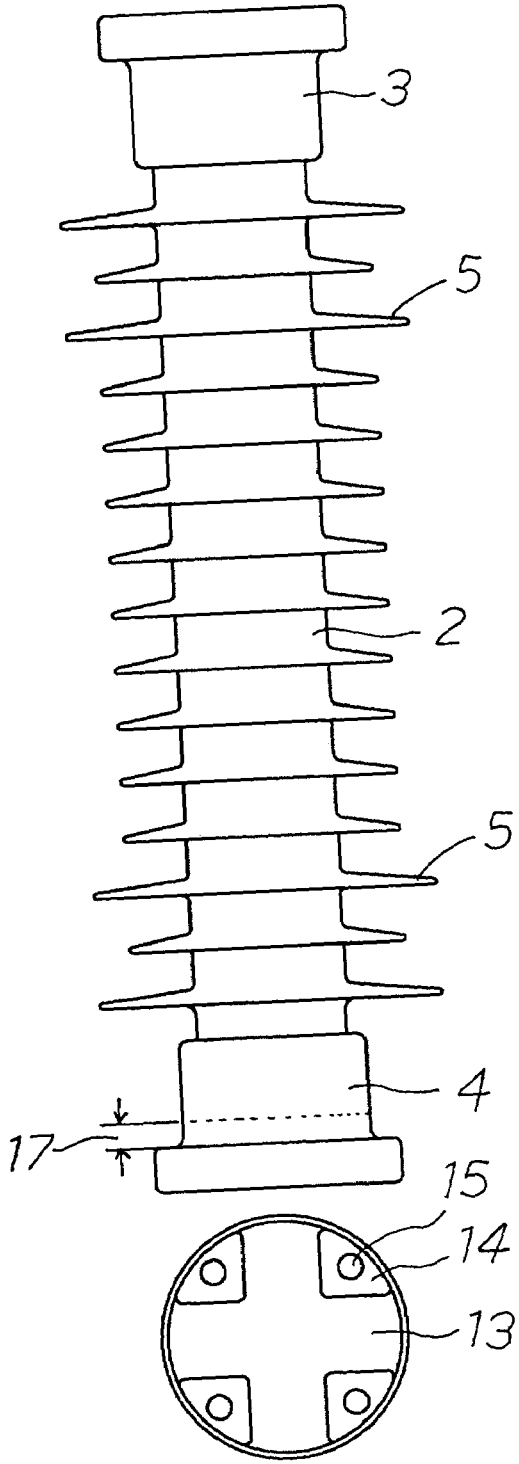
FIG. 6 is a front view and a bottom view of polymer SP insulator of the invention.

As shown in FIG. 6, in the outer bottom of the lower metal-end-fitting 4, a stress concentration portion 13 is provided in order to deform the flange outer edge of the metal-end-fitting 4 by following up to the tubular part 7 side when the tubular part 7 of the metal-end-fitting 4 is crimped.

Figure 7:
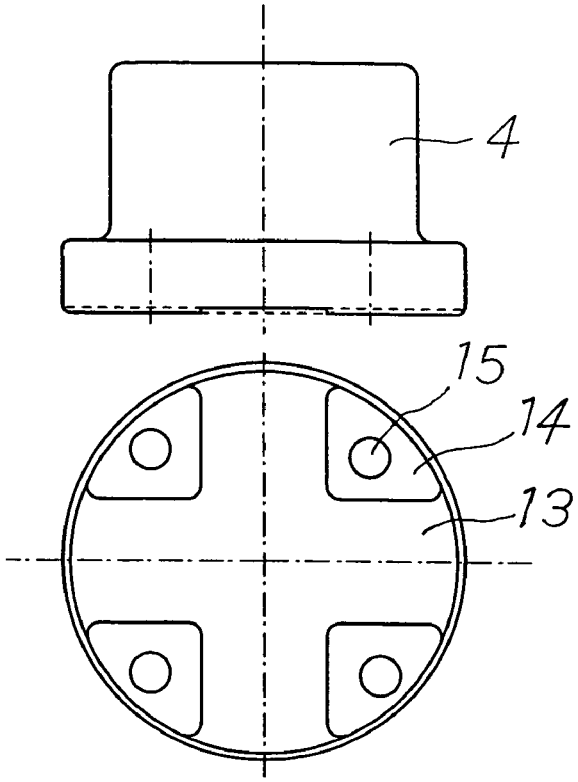
FIG. 7 is a front view and a bottom view of metal-end-fitting in lower part of polymer SP insulator of the invention.
Figure 8:
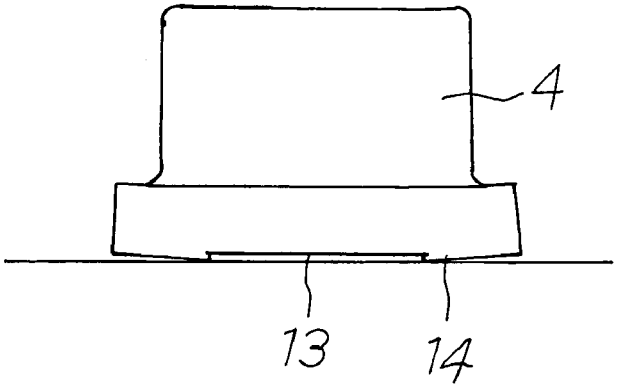
FIG. 8 is a front view of metal-end-fitting in lower part in flange deformed state.

The stress concentration portion 13 is not particularly specified in shape, but a shallow groove of cross bottom is formed in the embodiment as shown in FIG. 7. When the tubular part 7 of the metal-end-fitting 4 is crimped, the flange 8 is also curved and deformed, and when such cross groove is formed, the stress is concentrated in this portion, and the cross groove is deformed in advance, and the protruding portion 14 other than the groove is hardly deformed relatively. Accordingly, if the flange 8 is deformed, stability is assured by the protruding portion 14 as shown in FIG. 8, and the parallelism and eccentricity can be suppressed within the required range of ANSI standard etc. A bolt hole for fixing 15 is formed in each protruding portion 14.

Figure 9:
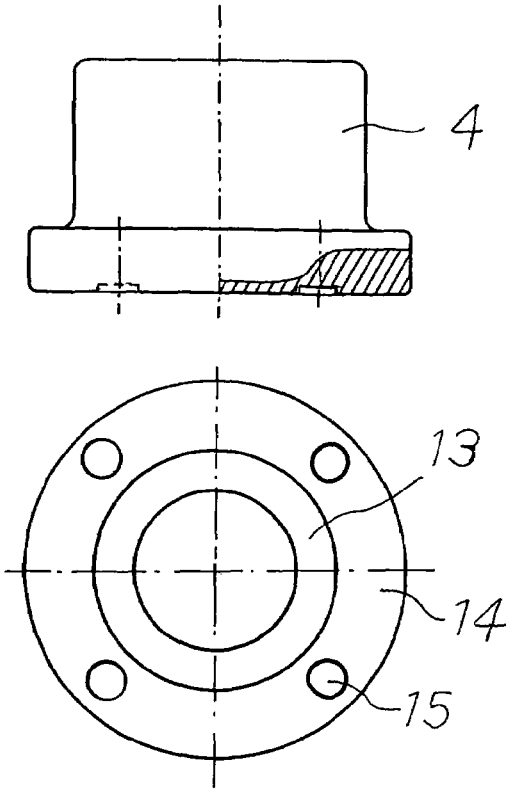
FIG. 9 is a front view and a bottom view of other embodiment of metal-end-fitting in lower part.
Figure 10:
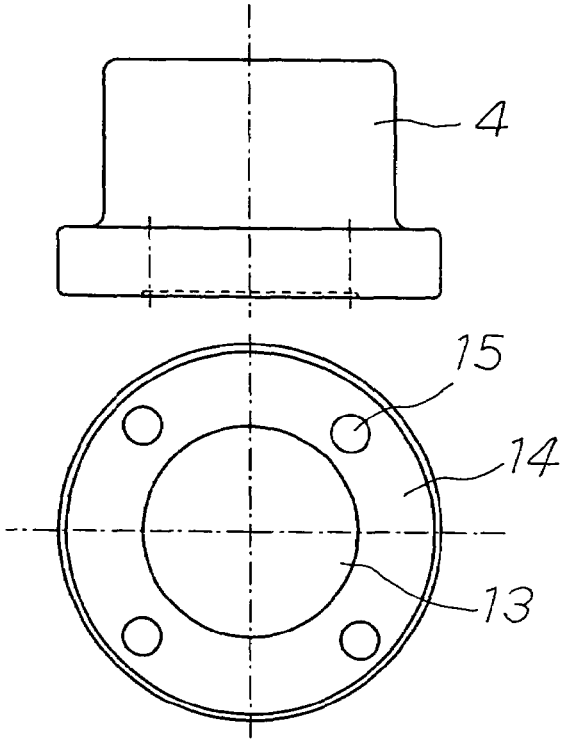
FIG. 10 is a front view and a bottom view of another embodiment of metal-end-fitting in lower part.

The shape of stress concentration portion 13 is not limited to the one shown in FIG. 7, but may be formed in a ring groove as shown in FIG. 9, or circular groove as shown in FIG. 10, and the outer periphery may be formed as protruding portion 14.

As stated above, by forming the stress concentration portion 13 at least in the outer bottom of lower metal-end-fitting 4, eccentricity stability is enhanced, and moreover as shown in FIG. 6, eccentricity stability may be further enhanced by leaving a non-crimping portion 17 by 15% or more of overall height of the metal-end-fitting 4 in the portion on the flange of the tubular part 7 of the metal-end-fitting 4 as shown in FIG. 6. That is, if the tubular part 7 is crimped up to the vicinity of flange 8, the deformation amount of flange 8 increases, and hence it is preferred to leave a non-crimping portion 17 by 15% or more of the length. However, if the non-crimping portion 17 is too long, the strength is lowered, and hence it should not be equal to or longer than 30%.

Figure 1:
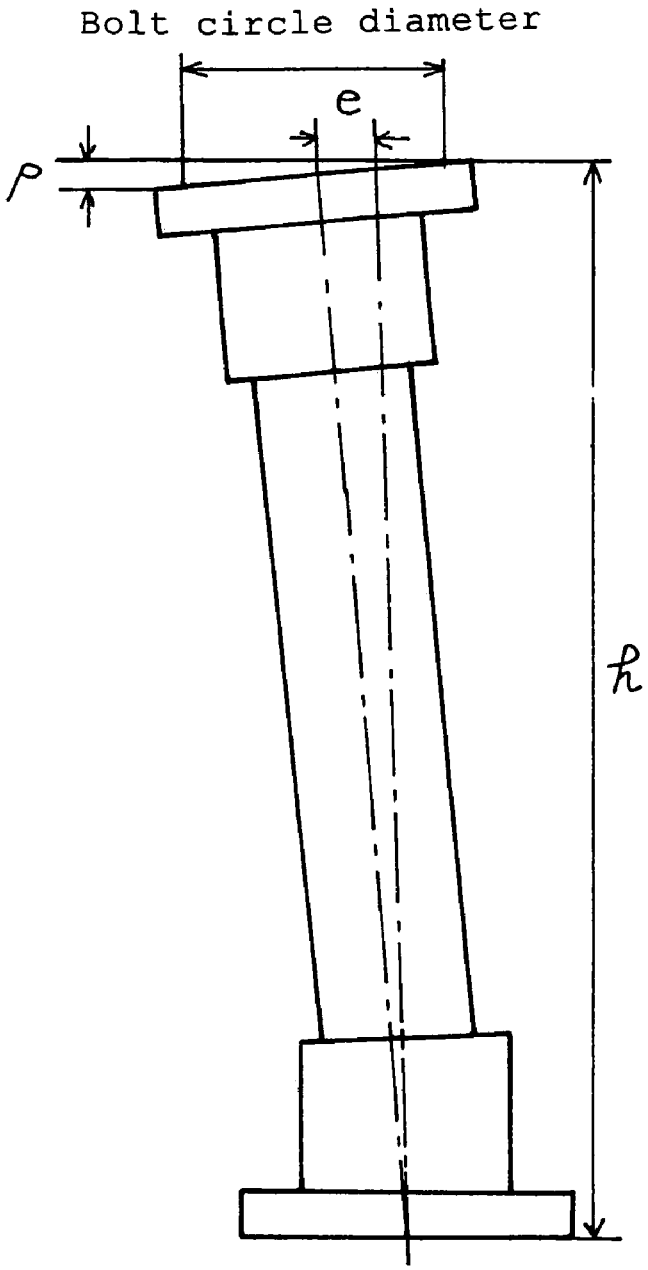
FIG. 1 is an explanatory diagram of measuring method of overall length h, parallelism p, and eccentricity e of polymer SP insulator.
Figure 2:
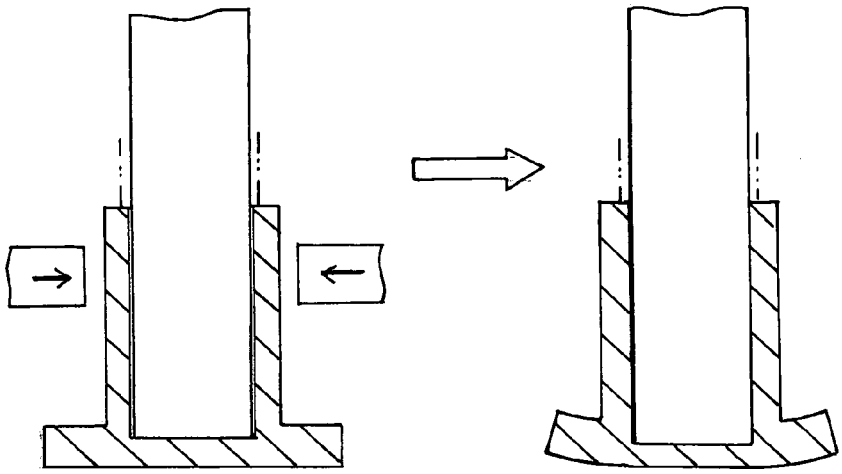
FIG. 2 is a sectional view showing curvature and deformation of flange by crimping metal-end-fittings.

Table 1 shows the relation of ratio of non-crimping portion, parallelism and eccentricity. The ratio of non-crimping portion is the distance between lower end of crimping portion and upper end of flange divided by the overall height of metal-end-fitting. Parallelism and eccentricity are as explained in FIG. 1. As clear from this table, parallelism and eccentricity can be suppressed when the ratio of non-crimping portion is 15% or more.

TABLE 1

| Ratio of non-crimping portion□ | 20% | 15% | 10% | 5% |
|---|---|---|---|---|
| Parallelism□ | 0.8 mm or less | 0.8 mm or less | 1.5 mm or less | 1.9 mm or less |
| Eccentricity□ | 3.2 mm or less | 3.2 mm or less | 6.6 mm or less | 9.1 mm or less |

Further, to suppress deformation of metal-end-fittings 3, 4 at the time of crimping, it is effective to reduce the clearance between inner periphery of metal-end-fittings 3, 4 and outer periphery of FRP core 1.

As stated above, since the polymer SP insulator has a structure of crimping and fixing metal-end-fittings 3, 4 at upper and lower ends of FRP core 1, in order to guarantee the same mechanical strength as the porcelain-made SP insulator, it is necessary to design the metal-end-fittings 3, 4 longer as compared with the porcelain-made SP insulator. But it is regulated by the standard and the overall length cannot be changed, and hence the flash over distance between metal-end-fittings 3 and 4 becomes shorter. In this preferred embodiment, therefore, the diameter of sheds 5 of at least highest position and lowest position is set larger than the diameter of intermediate shed. As a result, flashover distance between metal-end-fittings 3 and 4 is assured, and lowering of insulation characteristic can be prevented.

The diameter of all sheds of the sheath 2 can be expanded, but by increasing the diameter of sheds of at least highest position and lowest position more than the intermediate shed diameter, the volume of shed materials can be suppressed as compared with the case of expanding the diameter of all sheds, and the flashover distance can be assured economically. Besides, running rainwater can be released outside, it is also effective to improve the dielectric strength in flooding.

As explained herein, the polymer SP insulator of the invention having a structure of crimping metal-end-fittings at upper and lower ends of FRP core is capable of suppressing the overall length tolerance within the required range of ANSI standard etc, and also suppressing the parallelism and eccentricity within the required range of ANSI standard etc.

What is claimed is:

1. A polymer SP insulator comprising an FRP core, a sheath having a plurality of sheds provided on outer periphery of FRP core, and metal-end-fittings crimped to upper and lower ends of FRP core, wherein a flat plate for adjusting the overall length dimension after crimping the metal-end-fittings is assembled in the inner bottom of both or one of upper and lower metal-end-fittings, and a stress concentration portion is provided in the outer bottom of at least lower metal-end-fitting to deform the flange outer edge of the metal-end-fitting toward the tubular part without the entire bottom of the flange being deformed at the time of crimping the tubular part of the metal-end-fitting.

2. The polymer SP insulator according to claim 1, wherein the stress concentration portion is formed in a cross groove.

3. The polymer SP insulator according to claim 1, wherein a non-crimping portion is provided in the tubular part by 15% or more of overall height of the metal-end-fitting, close to the flange of the metal-end-fitting.

4. The polymer SP insulator according to claim 1, wherein the diameter of sheds of at least highest position and lowest position is larger than the diameter of intermediate shed.

* * * * *